US005495874A

United States Patent [19]

Heiman

[11] Patent Number: 5,495,874

[45] Date of Patent: Mar. 5, 1996

[54] WOVEN FABRIC SHEETING

[75] Inventor: Gary L. Heiman, Cincinnati, Ohio

[73] Assignee: Standard Textile Co., Inc., Cincinnati, Ohio

[21] Appl. No.: 232,828

[22] Filed: Apr. 22, 1994

[51] Int. Cl.[6] ..... D03D 15/00

[52] U.S. Cl. ..... 139/420 A; 139/426 R; 428/259

[58] Field of Search ..... 139/420 R, 420 A, 139/426, 383 R, 420 B; 428/259; 5/925, 926, 495

[56] References Cited

U.S. PATENT DOCUMENTS

| | | | |
|---|---|---|---|
| 4,063,885 | 12/1977 | Mares et al. | 139/420 A |
| 4,191,221 | 3/1980 | Boyer | 139/426 R |
| 4,534,819 | 8/1985 | Payet et al. | 156/515 |
| 4,670,326 | 6/1987 | Heiman | 139/420 R |
| 4,724,183 | 2/1988 | Heiman | 139/420 R |
| 5,364,683 | 11/1994 | Flint et al. | 428/141 |

FOREIGN PATENT DOCUMENTS

| | | | |
|---|---|---|---|
| 4091251 | 3/1992 | Japan | 139/420 A |
| 1675428 | 9/1991 | U.S.S.R. | 139/420 A |

*Primary Examiner*—Andy Falik
*Attorney, Agent, or Firm*—Kinney & Schenk

[57] ABSTRACT

A woven fabric sheeting combines the comfort features of cotton fabrics with the durability advantages of polyester fabrics. The sheeting construction is characterized by the use of cotton warp yarns and continuous filament, texturized, polyester filling yarns.

21 Claims, No Drawings

WOVEN FABRIC SHEETING

The present invention relates to improvements in woven fabric sheeting.

Relatively light weight (roughly 3 –4 ounces per square yards) woven fabrics have long been used as fabrics for sheets, pillow cases and similar items. These items are known as bed linens, though, traditionally, they are most often woven from cotton yarns. The fabric from which bed linens (also known as "bedding") are made is known as, and is herein referenced as, "sheeting".

While the desired "feel" for bed linens is subjective, it is commonly accepted that the "feel" of cotton bedding is preferred by most persons. In addition to its desirable "feel" factor, cotton has an absorbency that tends to keep a person's skin dry. These factors are of extreme importance to a bedridden person, as a hospital patient and, in addition to comfort, contribute to a minimization of bed sores, as well as generally contributing to a positive mental outlook on the part of the patient. The term "hand" is also used by those in the textile industry to indicate tactile characteristics of a fabric which are referenced herein by the term "feel".

However, a basic shortcoming of cotton sheeting is that it has a relatively short usable life. Primarily the usable life of bed linens is a function of the number of times it is laundered and ironed (ironing is not necessarily done after each laundering). In most instances the wear and tear on bed linens is much greater in laundering and ironing than in its actual use on a bed.

The economic factors relating to bed linens are accentuated in a hospital environment, where bedding is usually changed daily and often changed multiple times a day.

Within certain limits the economic factors can be manipulated by the construction parameters of the sheeting from which the bed linen items are made. Thus, heavier/coarser or lighter/finer yarns can be used and the yarn count can be varied. (Yarn count, also referenced as "total yarn count" or "round count", is the combined number of filling yarns and warp yarns in a given area of a fabric, typically expressed in terms of yarns per square inch).

It is to be emphasized that the "purchase price", i.e., the "acquisition price" of a bedding item is not controlling as to cost of use. The true cost of a bedding item is its acquisition cost, plus its total laundering and ironing costs, divided by the number of times it can be used. The true cost of bedding items is, inherently controlled by the sheeting from which the item is made and the cost and durability characteristics of that sheeting. The "feel" of the bedding item is, likewise, controlled by the "feel" of the sheeting. "Durability" is herein used to denote a fabric's resistance to degradation in use, including its resistance to degradation when subjected to laundering and ironing.

There are various grades of cotton yarn, which can and do affect the "feel" of sheeting, as well as its durability.

With the relatively recent development of synthetic resin yarns, the durability of fabrics in general has been greatly improved. Polyester has proven to be a particularly useful resin for textile use, particularly in the medical/hygienic field where frequent laundering and sterilization are routine. There are three basic procedures for producing polyester yarns (and yarns of other synthetic material). The basic yarns are formed by an extrusion process that produces filaments of extremely small cross section (on the same order of magnitude of cotton fibers). These continuous filaments may be joined with, or without, a minimal twist to form a yarn of a given denier. A second type of yarn is referenced as "texturized" yarn, which involves a further step of crimping or otherwise causing the filaments to assume a non-linear configuration. The third method involves chopping the extruded filaments into relatively short lengths, "staple" and then spinning the staple to form a yarn (also referenced as a thread). In forming spun yarns, polyester staple can be combined with staple formed of other synthetic materials or combined with natural staple.

There have been many fabrics in which the durability and other desirable characteristics of polyester have been combined with the desired "feel" and other characteristics of cotton through the use of yarns spun from polyester and cotton staples. Sheeting fabrics employing spun cotton/polyester yarns are taught in U.S. Pat. Nos. 4,578,306 and 4,724,183, both being of common assignment with the present application.

In the '306 and '183 patents the warp yarns are formed of a blend of natural and synthetic material (cotton/polyester) and the filling yarns (also referenced as weft yarns) are formed of natural fibers (cotton).

More specifically, the '306 patent teaches a preferred fabric in having a total yarn count of 192(yarns/sq. in.—110 warp/82 filling). Long staple combed cotton was employed in both the warp and filling yarns. The cotton content of the sheeting material is 70% and the plain weave is such that the surface area comprises approximately 80% cotton by weight.

The preferred fabric of the '183 patent differs from that of the '306 patent in that it had a total yarn count of 143(yarns/sq. in.—75 warp/68 filling). The cotton was carded cotton, with the cotton content of the fabric being 75% by weight. Again the surface area of the fabric comprised approximately 80% cotton.

It is also to be recognized that there are many other fabric constructions that incorporate various combinations of cotton and polyester yarns, as well yarns formed of other natural materials, such as silk, and other synthetic materials such as nylon. It is also to be recognized that these various forms of yarns have been used as both warp yarns and filling yarns, also in various combinations.

The point being made is that there is a virtually infinite number of combinations and permutations of yarns and yarn materials that may be employed in weaving fabrics. Notwithstanding, only a very limited number of yarn constructions will satisfy, in a practical fashion, the needs and functions of bed linens, particularly those for health care usage.

The fabrics of the above identified patents define unique yarn constructions that, among other things, are characterized by the use of spun cotton/poly warp yarns and cotton filling yarns. With this basic construction warp and filling yarn relationship, it is possible to obtain a sheeting that has the desired cotton characteristics, while at the same time, the durability characteristics of polyester are also obtained.

Of the two referenced fabrics, the '306 fabric has a total yarn count of 190 and possesses a superior cotton "feel". The '306 fabric comprises 110 warp yarns and 82 filling yarns, with 70% of the fabric, by weight, being cotton. Further, the fabric weight was 3.72 oz./sq. yd., with 80% of the fabric surface being cotton.

The '183 fabric finds advantage in that it is less expensive to manufacture, with only a minimal loss of cotton characteristics and with essentially the same durability characteristics as in the '306 fabric. The ends and the economies of the '183 fabric are achieved by a reduction in the total yarn count to 140. Further, the ratio of warp yarns to filling yarns is substantially reduced with 75 warp yarns and 68 filling yarns. The fabric weight was somewhat increased to 3.88 oz./sq. yd., with the cotton content of the fabric being 75%, by weight, and with the surface of the fabric again being comprised of 80% cotton. In part, the reduced cost of the '183 fabric was derived from a reduction in filling yarn density to 68 per inch from 82 per inch, employed in the '306 fabric.

By reducing filling yarn density, the rate of operation of a loom can be increased and the cost of manufacturing a fabric is proportionately reduced.

The object of the present invention is to provide an improved, fabric sheeting which has a blend of the durability characteristics of a polyester fabric and the "feel", absorbency and other desirable characteristics of a cotton fabric, and particularly to do so in a fashion that reduces the acquisition cost of sheeting and bed linens and other products made therefrom.

The ends of the invention are generally attained by a fabric sheeting construction wherein the warps of the sheeting are formed by cotton yarns and the filling yarns are polyester yarns, preferably, continuous filament polyester yarns. It is further preferred that the continuous filament, polyester yarns be textured, with a further preference for the use of core and affect texturized yarns. The sheeting is comprised of the cotton warp and the polyester filling yarns appearing on and defining both its top and bottom fabric surfaces.

Other preferred features of the fabric sheeting include a total yarn count of 100 to 150 (yarns per square inch), a warp yarn count of 70–90 (per inch), a ratio of warp yarns to filling yarns between 1.6/1 and 2.2/1, a weight of 3.1 to 3.4 oz./sq. yd. a cotton content, on a weight basis, of 60%–70%.

The above and other related objects features of the invention will be apparent from a reading of the following description of the invention which includes reference to an example of a fabric sheeting that embodies advantageous relationships of the preferred features of the invention, and the novelty thereof set forth in the appended claims.

A drawing is not required for an understanding of the invention.

DESCRIPTION OF THE INVENTION

The manufacture, i.e., weaving, of sheeting is a well known process, with various and sundry weaving machines being available for the forming of continuous lengths of fabric sheeting. With the fabric constructions herein described, a person skilled in the art will be able to manufacture sheeting in accordance with the teachings of the present invention.

A basic construction feature is the use of cotton yarns as the warp yarns and continuous filament, polyester yarns as the filling yarns of the sheeting. Another construction feature is found in a total yarn count ranging between, approximately, 100 and 150 (per sq. inch). The number of warp yarns may range from 70 to 90 per inch. It is further preferred that the ratio of warp to filling yarns range between 1.6/1 and 2.2/1. Additionally, the preferred range of sheeting weight is between 3.1 and 3.4 oz./sq. yd. Also, it is preferred that, on a weight basis, the cotton content of the sheeting comprise 60%–70%, with the balance being polyester. With these parameters set, one skilled in the art may readily select commercially available yarns of appropriate weight for both the warp and filling yarns. It is further preferred that the fabric be a 1×1 plain weave.

The warp yarns are spun cotton yarns. There are various forms and types of known, cotton yarns. The warp yarns for the sheeting of the present invention may be selected from such known types, as desired.

The present invention focuses on cotton as the natural material for forming the warp yarns. It is to be appreciated that the broader aspects of the invention are generally applicable to other natural materials. For example, to some persons silk bed linens have a distinctive, and desirable "feel" and comfort factor. The minimization of acquisition cost and increased durability features of the present invention would also be available to provide a sheeting that is characterized by a silk "feel", through the use of silk yarns as the warp yarns of the fabric construction.

As indicated the filling yarns are characterized by being formed of polyester. The use of polyester yarns as filling yarns enables the sheeting to have a substantially higher strength in filling yarn direction of the sheeting, with a minimum amount of polyester weight and a minimum number of filling yarns (also known as "picks"). Higher strength in the filling yarn direction enables sheets, manufactured from this fabric sheeting, to better withstand the stresses on the fabric that are incident to the rigors and stresses of institutional processing (i.e., washing, drying and flat work ironing) particularly ironing. This is to point out that the orientation of the sheets, as they are processed in institutional ironing machines, or mangles, is such that they are highly stressed in the direction of the filling yarns. As a result, where cotton yarns are employed as filling yarns, sheets will wear and lose their structural integrity because of a failure of the filling yarns brought on by repeated ironing cycles. The use of polyester filling yarns enhances the wear life of bed linens made from the present sheeting, by enhancing the sheeting's strength in the filling yarn direction.

Referencing the earlier discussion of polyester yarns, the preferred form of filling yarn is a yarn comprised of a multiplicity of continuous, polyester filaments. The continuous filament yarn eliminates a "pilling" problem that exists with respect to the fabrics of the above referenced '306 and '183 patents. This is to point out that spun cotton/polyester yarns, as used in those fabrics, experience a degradation in which small lengths of the cotton staple break off and cohere into small balls, referenced as "pills", that tend to cling to the fabric. Continuous filament yarns, as preferably employed in the fabric construction of the present invention, do not suffer from this "pilling" problem.

It is further preferred that the continuous filament polyester, filling yarns be texturized. This texturization provides a "bulk", as well as "feel" for the sheeting, which approximates the "bulk" and "feel" of cotton sheeting, while permitting the weight of the fabric to be reduced.

The use of texturized filling yarns also contributes to the economy of the present sheeting, in that the number of filling yarns, relative to the number of warp yarns can be minimized. The use of a relative few number of filling yarns decreases the costs of manufacturing/weaving the sheeting. This brings out one aspect of the significance of the preferred range of warp yarns to filling yarns (1.6/1 to 2.2/1) referenced above. Again it is to be remembered that these economies are attained while, at the same time, providing a fabric sheeting that is characterized by having "feel", absorption and other desirable characteristics approaching those of a 100% cotton sheeting.

It will be further noted that the preferred, texturized filling yarns should be "set", i.e., heated to relax the molecular structure to the end that elasticity of the yarns is minimized and there will be a minimum of stretch in the sheeting.

As indicated above the fabric sheeting of the present invention may be woven on conventional looms. Preferably, the sheeting is taken in its as woven form to a fabricator of sheets, pillow cases, or other bed linens and so converted. This is to say that it is preferred for the sheeting to be free of finishes that might tend to degrade the cotton or polyester materials, or cause the polyester yarns to lose their brightness after repeated institutional launderings.

For a point of reference, the term "institutional laundering" denotes a cycle of high temperature washing involving the use of strong detergents, successive rinses followed by high temperature drying. In most instances each item is also ironed following the institutional laundering cycle. That this institutional laundering cycle is rigorous is demonstrated by the fact that convention bed linens, constructed of 50/50 cotton/poly warp and filling yarns, typically must be replaced after some 68 cycles and 100% cotton bed linens have an even shorter useful life.

EXAMPLE

A length of fabric sheeting was plain woven on a conventional loom having the capability of weaving a wide variety of fabric constructions, The following construction was woven:

| | |
|---|---|
| Warp Yarn: | 100% Spun Cotton, Open End |
| Weight: | 23 cotton count ($N_c$) |
| Filing Yarn: | 100% polyester texturized yarn |
| Weight: | 164 denier |
| Total Yarn Count: | 120.1 |
| Warp Count: | 75.9 |
| Filling Count: | 44.2 |
| Warp/Filling: | 1.725 |
| Fabric Weight: | 3.24 oz./sq. yd. |
| Cotton Weight: | 64% |
| Polyester Weight: | 36% |

The fabric sheeting was tested to determine its tensile strength in the warp and filling yarn directions with the following results:

| | |
|---|---|
| Warp: | 57.4 lbs.* |
| Filling: | 99.0 lbs.* |

*ASTM D 1682-75 (Cut Strip Pull Test)

The fabric sheeting was made up into several sheets, both plain and "fitted". These sheets were distributed to several hospitals where they were subjected to successive institutional laundering cycles, with the sheets being ironed between each laundering cycle. In all instances, the sheets were usable after at least as many cycles corresponding sheets made from the fabrics of the '183 and '306 patents referenced above.

It is to be noted that the target fabric strength in the filling yarn direction is 75 pounds*, this being sufficient to withstand the rigors of institutional processing. The 99 pounds strength of the Example thus exceeds the target strength.

The foregoing Example represents a preferred embodiment of the present invention.

While the preferred practice of the present invention is to employ continuous filament polyester yarns, certain of the broader aspects of the invention may be attained through the use of other forms of polyester filling yarns. Thus, again as to the broader aspects of the invention, it would be possible to employ spun polyester yarns as the filling yarns in the fabric construction otherwise defined above. It is to be recognized that, with the present state of technology, spun yarns are more expensive than continuous filament yarns. Further, spun yarns also have other drawbacks, including the "pilling" problem discussed above. However, should these problems be otherwise overcome, then spun polyester yarns would be suitable as filling yarns for the present sheeting construction.

Variations from the disclosure herein will occur to those skilled in the art, within the spirit and scope of the present inventive concepts, as set forth in the following claims.

Having thus described the invention, what is claimed as novel and desired to be secured by Letters Patent of the United States is:

1. A woven fabric sheeting having a combination of the "feel" and absorption characteristics of cotton and the durability characteristics of polyester, said sheeting being formed by warp yarns and filling yarns and said yarns occupying and defining the top and bottom surfaces of the sheeting, said sheeting being characterized in that the warp yarns are yarns comprised essentially of spun cotton staples, and the filling yarns are predominantly continuous filament, polyester yarns.

2. A woven fabric sheeting having a combination of the "feel" and absorption characteristics of cotton and the durability characteristics of polyester, said sheeting being formed by warp yarns and filling yarns and said yarns occupying and defining the top and bottom surfaces of the sheeting, said sheeting being characterized in that the warp yarns are spun cotton yarns, and the filling yarns are continuous filament, polyester yarns, and further characterized in that the filling yarns are a texturized yarn.

3. A woven fabric sheeting having a combination of the "feel" and absorption characteristics of cotton and the durability characteristics of polyester, said sheeting being formed by warp yarns and filling yarns and said yarns occupying and defining the top and bottom surfaces of the sheeting, said sheeting being characterized in that the warp yarns are spun cotton yarns, and the filling yarns are continuous filament polyester yarns, and further characterized in that the total yarn count is between approximately 100 and 150.

4. A woven fabric sheeting as in claim 3, further characterized in that the filling yarns are a texturized yarn, and the total yarn count is approximately 120.

5. A woven fabric sheeting as in claim 4, further characterized in that the ratio of warp yarns to filling yarns is approximately 1.7/1.

6. A woven fabric sheeting as in claim 5, further characterized in that the warp yarn count is approximately 76.

7. A woven fabric sheeting as in claim 6, further characterized in that the weight of the sheeting is approximately 3.24 oz./sq. yd.

8. A woven fabric sheeting as in claim 7, further characterized in that sheeting comprises approximately 64% cotton by weight.

9. A woven fabric sheeting as in claim 5, further characterized in that the sheeting has a tensile strength in the filling yarn direction of at least about 75 pounds, measured pursuant to ASTM D 1682-75.

10. A woven fabric sheeting as in claim 3, further characterized in that the ratio of warp yarns to filling yarns is between approximately 1.6/1 to 2.2/1.

11. A woven fabric sheeting as in claim 10, further characterized in that the warp yarn count is between approximately 70 and 90.

12. A woven fabric sheeting as in claim 3, further characterized in that the weight of the sheeting is approximately 3.1 to 3.4 oz./sq. yd.

13. A woven fabric sheeting as in claim 12, further characterized in that the weight of the sheeting is approximately 3.24 oz./sq. yd.

14. A woven fabric sheeting as in claim 3, further characterized in that sheeting comprises approximately 60%–70% cotton by weight.

15. A woven fabric sheeting as in claim 1, further characterized in that sheeting comprises approximately 60%–70% cotton by weight.

16. A woven fabric sheeting having a combination of the "feel" and absorption characteristics of cotton and the durability characteristics of polyester, said sheeting being formed by warp yarns and filling yarns, said sheeting being characterized in that the warp yarns are spun cotton yarns, and the filling yarns are continuous filament, polyester yarns, and further characterized in that the weight of the sheeting is approximately 3.1 to 3.4 oz./sq. yd. additionally.

17. A woven fabric sheeting having a combination of the "feel" and absorption characteristics of cotton and the durability characteristics of polyester, said sheeting being formed by warp yarns and filling yarns and said yarns occupying and defining the top and bottom surfaces of the sheeting, said sheeting being characterized in that the warp yarns are spun cotton yarns, and the filling yarns are essentially 100% polyester material.

18. A woven fabric sheeting as in claim 17, further characterized in that the filling yarns comprise 100% polyester staples.

19. A woven fabric sheeting having a combination of the "feel" and absorption characteristics of a natural fiber yarn and the durability characteristics of a synthetic material yarn, said sheeting being formed by warp yarns and filling yarns and said yarns occupying and defining the top and bottom surfaces of the sheeting, said sheeting being characterized in that the warp yarns are natural fiber yarns, and the filling yarns are comprised of essentially 100% synthetic material.

20. A woven fabric sheeting as in claim 19, further characterized in that the filling yarns comprise continuous, extruded filaments.

21. A woven fabric sheeting as in claim 19, further characterized in that the filling yarns comprise spun synthetic staple.

* * * * *